United States Patent [19]

Cain

[11] Patent Number: 4,475,660

[45] Date of Patent: Oct. 9, 1984

[54] CADDY FOR JANITORIAL SUPPLIES

[76] Inventor: Charles R. Cain, 259 Winn St., Burlington, Mass. 01803

[21] Appl. No.: 498,484

[22] Filed: May 26, 1983

[51] Int. Cl.[3] ..... A47F 7/00

[52] U.S. Cl. ..... 211/113; 211/71; 211/88; 211/126; 294/143; 294/161

[58] Field of Search ..... 211/88, 71, 60 T, 60 R, 211/60 A, 65, 126, 113; 294/137, 141, 142, 143, 144, 159, 161; 206/561

[56] References Cited

U.S. PATENT DOCUMENTS

| | | | |
|---|---|---|---|
| D. 232,992 | 7/1972 | Molzen . | |
| 604,549 | 5/1898 | Spencer | 294/143 |
| 2,035,639 | 3/1936 | Davis | 211/60 T X |
| 3,606,949 | 9/1971 | Joyce | 294/161 X |
| 3,895,605 | 7/1975 | Goldman | 211/88 X |
| 3,986,649 | 10/1976 | Heimstra | 211/88 X |
| 4,140,256 | 2/1979 | King | 294/159 X |

*Primary Examiner*—Robert W. Gibson, Jr.
*Attorney, Agent, or Firm*—Ziems, Walter & Shannon

[57] ABSTRACT

A caddy for janitorial cleaning supplies in which a pair of compartmented supply-receiving units are supported in vertically spaced relation on a sheet-form standard capable of suspension by hooks from a circular or rectangular trash dolly as well as being capable of suspension from a manual carrying handle supported from the hooks. The caddy is additionally capable of standing erect on a floor to facilitate handling of multiple supplies in a janitorial service area.

5 Claims, 7 Drawing Figures

CADDY FOR JANITORIAL SUPPLIES

BACKGROUND OF THE INVENTION

This invention relates to apparatus for handling janitorial cleaning supplies. More particularly, it concerns a rack-like caddy for retaining an assortment of cleaning supplies in a manner so that the supplies may be suspended from a trash dolly, for example, or manually carried in the caddy which is capable of standing erect on a floor or other horizontal surface.

In the daily cleaning of office and other commercial buildings, it is common practice for janitorial personnel to be equipped with a trash dolly and an assortment of supplies such as cleaning fluids, rags, sponges, trash basket liners, and the like, so that trash collection and cleaning services in a given area or office may be accomplished with required supplies at hand. Trash dollies used in this work are relatively large and are mounted on caster wheels to facilitate maneuverability of the dollies through doors and around furniture to the various locations of small trash receptacles or waste baskets to be emptied into the trash dolly during the daily cleaning operation. The size and the wheeled character of the trash dollies enables them to serve also in the manner of a cart to support and carry the various supplies allocated to each cleaning person or work crew. In the absence of any other specific provision, for example, it is common practice for the cleaning supplies to be placed in the dolly or in a bag which is, in turn, tied or otherwise fixed to the trash dolly. Alternatively, the dolly may be fitted with a tray or an appurtenance designed for the support of cleaning supplies in the dolly.

With existing equipment and practices, at least two major problems are presented to janitorial contractors or others charged with responsibility for cost-effective office cleaning services. The first of these problems involves the inefficient handling of janitorial supplies which are moved from area to area by attachment to a trash dolly whether by design or by custom. Where individual cleaning compositions or implements are removed from the trash dolly for use, a measure of inefficiency results from multiple trips between the point of use and the trash dolly. In addition, various components of the cleaning supplies removed from the trash dolly are often left in the area being cleaned thereby reducing cost effectiveness and providing a source of irritation to the occupants of the space being cleaned.

The second and perhaps more significant problem resulting from support of cleaning supplies on trash dollies is that substantial losses of janitorial supplies are incurred as a result of the supplies being dumped simultaneously with emptying the trash dolly into a larger repository for the trash. The large number of such incidents resulting solely from the practice of supporting cleaning supplies on trash dollies accumulates to a major item of waste and expense to the servicing of a large office building, not to mention the industry as a whole.

Accordingly, there is a need for improvement in apparatus for handling cleaning fluids and other supplies in the performance of janitorial services of the type represented by daily maintenance of large office and other commercial buildings.

SUMMARY OF THE INVENTION

In accordance with the present invention, a rack-like caddy is provided by which an assortment of janitorial supplies may be retained for easy removal and replacement and which is capable of removable support as a unit from existing variably shaped trash dollies, capable of being manually handled and capable of support on a floor or other horizontal surface. Structurally, the caddy includes a substantially rigid sheet-like standard to which is attached at least one, preferably two, compartmented units defining tiers of open-top cells oriented to present a rearwardly concave arcuate configuration. The sheet-form standard is fixed to the lowest compartmented unit to be flush with the floor of that unit so that a combination of the floor and the arcuate configuration of the unit lends stability in the support of the caddy on a horizontal surface. Suspension hooks extend from the upper portion of the sheet-form standard, each of the hooks having a reach of a length extending rearwardly beyond a plane containing the rear surfaces of the caddy. As a result of this latter feature, the hooks may be used to suspend the caddy either from a planar wall of a rectangular caddy or from the cylindrical wall of circular trash dollies.

A principal objective of the present invention is, therefore, the provision of a caddy for handling, storing and using janitorial supplies in conjunction with a trash dolly. Other objects and further scope of applicability of the present invention will become apparent from the detailed description to follow, taken in conjunction with the accompanying drawings, in which like parts are designated by like reference numerals.

DETAILED DESCRIPTION OF THE PREFERRED EMBODIMENTS

Figure 1:
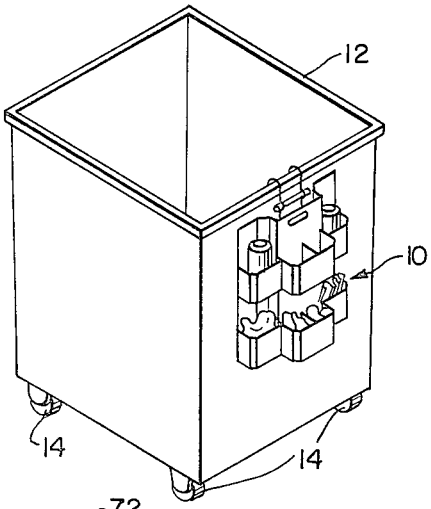
FIG. 1 is a perspective view illustrating the caddy of the present invention suspended from a rectangular trash dolly.

In FIG. 1 of the drawings, the caddy of the present invention is generally designated by the reference numeral 10 and shown to be suspended from one wall of a rectangular trash dolly 12 conventionally supported by caster wheels 14. A more complete understanding of the structure of the caddy 10 and, in particular, a preferred embodiment thereof may be understood by reference to FIGS. 2–4 of the drawings.

Figure 2:
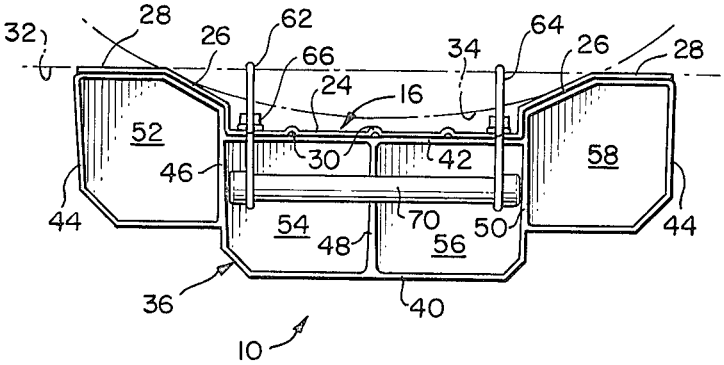
FIG. 2 is a plan view of the caddy of the present invention illustrating the outline of a circular trash dolly in phantom lines.
Figure 3:
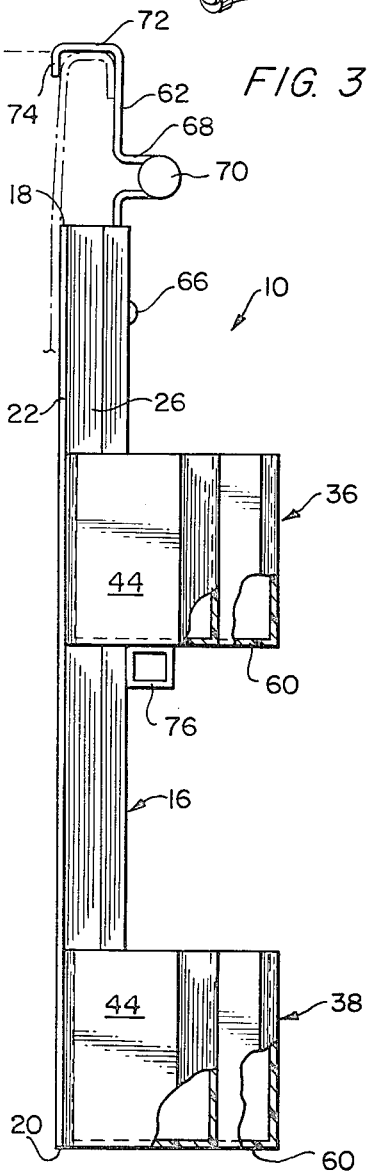
FIG. 3 is a side elevation of the caddy embodiment illustrated in FIG. 2.
Figure 4:
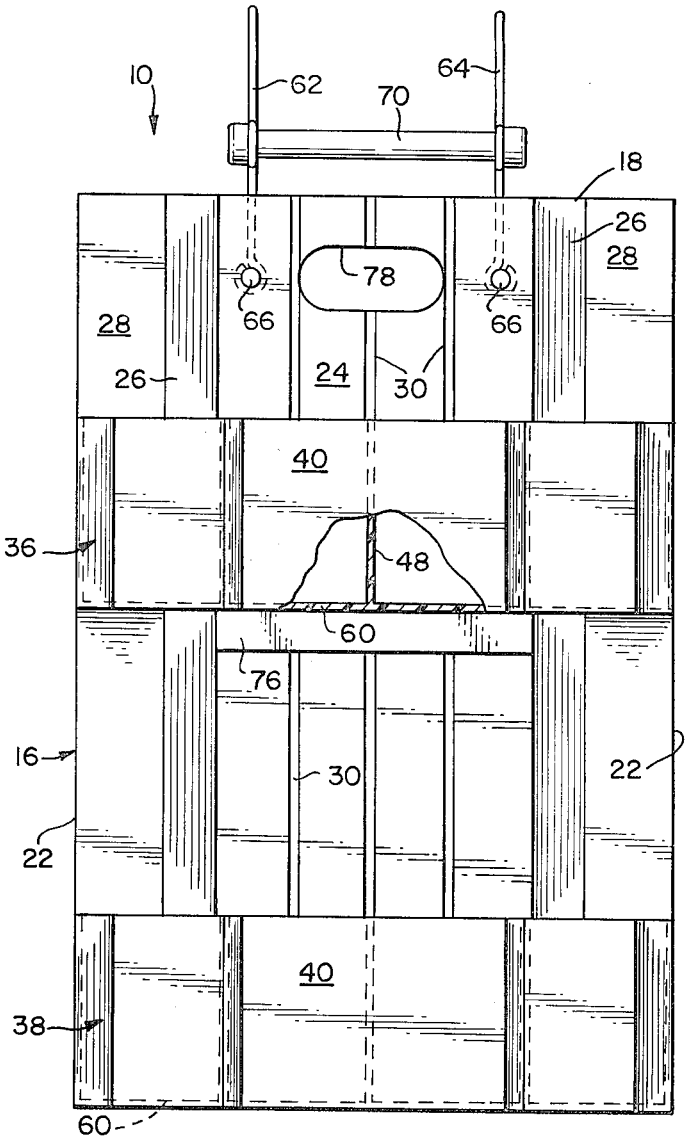
FIG. 4 is a front elevation of the caddy shown in FIGS. 2 and 3.

In the embodiment disclosed in FIGS. 2–4, basic structural integrity for the caddy 10 is provided in substantial part by a sheet-form standard 16 delimited by top, bottom and side edges 18, 20 and 22, respectively, to establish a generally rectangular peripheral configuration. The standard 16 is three dimensional as a result of its inclusion of a central channel portion 24 joining at opposite side edges with flared panel sections 26 which extend laterally and rearwardly from the channel section 24 to a pair of edge flanges 28. The web portion of the central channel section 24 may be provided with vertically extending, laterally spaced ribs 30 to impart rigidity where thickness of the standard 16, by itself, is not relied on to provide resistance against flexure in bending.

As illustrated in FIG. 2, the rear faces of the edge flanges 28 lie in a common plane 32 whereas a combination of depth in the central channel section 24 and the rearwardly flared panels 26 accommodate a circular arc 34. The plane 32 is also representative of the planar surface presented by the exterior of a rectangular trash dolly such as the dolly 12 illustrated in FIG. 1. The arc 34, on the other hand, is representative of trash dollies (not shown) in which the side walls are cylindrical in configuration. Thus, it will be observed that the rear surface of the sheet-form support 16 will lie against and be partially supported by the vertical exterior surfaces of either a circular or a rectangular trash dolly.

Projecting from the front surface of the standard 16 are upper and lower compartmented units 36 and 38, respectively. Each of the units 36 and 38 in the embodiment of FIGS. 2–4 is identically formed to include interconnected front, rear and end exterior vertical wall portions 40, 42 and 44, respectively. Additionally, internal vertical wall portions 46, 48 and 50 extend between the front and rear walls 40 and 42 to define open-top cells or compartments 52, 54, 56 and 58. The compartments 52, 54, 56 and 58 are closed at their bottom by a common planar floor 60 (FIGS. 3 and 4).

Although the cells 52–58 are approximately similar in size, it will be noted that the end cells 52 and 58 are disposed rearwardly of the middle cells 54 and 56 to provide a rearwardly concave configuration in the tier of cells represented by each of the compartmented units 36 and 38. The rear walls of the units, moreover, complement the front surface of the sheet-form standard 16 to facilitate securement of the units 36 and 38 directly against the front surface of the standard 16 using suitable adhesives or other means of attachment. Also, it is to be noted that in the disclosed embodiment, the cells 52–58 are complete in each of the compartmented units 36 and 38 due to the provision of the rear wall 42 in each instance. It is contemplated that where the units 36 and 38 are integrated with the sheet-form standard 16, the equivalent of the rear wall 42 will be provided by the front face of the sheet-form standard 16.

Secured at the upper end of the sheet-form standard 16 are a pair of upstanding hooks 62 and 64 attached to the standard 16 in the illustrated embodiment by bolts 66 though it will be appreciated that other specific forms of connection may be used. The hooks 62 and 64 are preferably formed of steel wire, and each are formed with an intermediate reverse bend 68 along the shanks thereof to receive opposite ends of a carrying handlebar 70. The reverse bend portions support the handlebar 70 forwardly of the front face of the standard 16 so that the weight of the loaded caddy is approximately centered under the handlebar 70. The hooks 62 and 64 define reaches 72 at their top ends which extend rearwardly through a distance so that downwardly projecting tips 74 of the hooks lie behind the plane 32 common to the rear surfaces of both flanges 28 or the rearwardmost surfaces of the caddy 10. In this way, and as may be appreciated from FIGS. 2 and 3, the reaches 72 of the hooks 62 and 64 are of a sufficient length to encompass either the top of a cylindrical dolly as represented by the arc 34 in FIG. 2, or of the top of a one side of a rectangular dolly as represented by the line 32 in FIG. 2.

Optional adjuncts to the caddy 10 in the illustrated embodiment may include, for example, a holder 76 for a feather duster fixed to the front face of the standard 16 under the upper compartmented unit 36. As shown in FIGS. 3 and 4, the holder 76 is in the nature of a rectangular tube which may be open at opposite ends. Also included as an option is a handle aperture or slot 78 provided in the channel section 24 of the sheet-form standard 16 near the upper end thereof. The slot 78 may be used in lieu of the handlebar 70 or may be used to suspend a plurality of the caddies 10 from an appropriate bar-like rack as during storage.

In use, the various cleaning and other janitorial supplies ordinarily used in routine daily maintenance of office and other commercial buildings may be supported in appropriate ones of the cells 52, 54, 56 and 58. Such supplies may include bottles of various cleaning fluids, trash receptacle liners, rags, sponges, and the like. The loaded caddy may be suspended from an empty trash dolly for transport between various areas or rooms to be serviced without interference of the dolly as a receptacle for trash to be removed from the serviced area. More importantly, the loaded caddy may be removed as a unit very easily by grasping the handlebar 70 for location at the point of use in the area being cleaned. In this respect, it is to be noted that an important feature of the caddy structure is that the sheet-form standard 16 extends down to be flush with the floor 60 of the lower compartmented unit. This feature coupled with the generally offset or rearwardly concave arcuate configuration of the lower unit 38 and the rigidity of the standard 16 enables the caddy to stand erect on a floor or other horizontal surface. Yet each of the cells 52–58 is completely accessible for removal and replacement of the various and sundry cleaning supplies carried therein.

Figure 5:
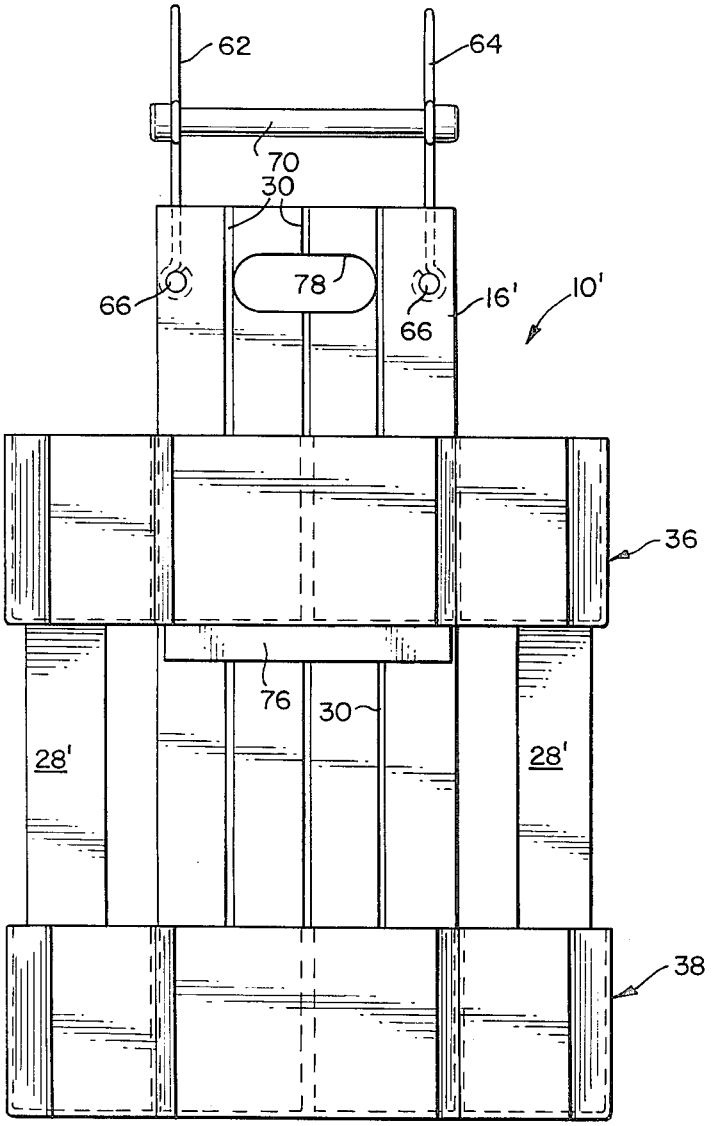
FIG. 5 is a front elevation of an alternative embodiment of the caddy of the present invention.
Figure 6:
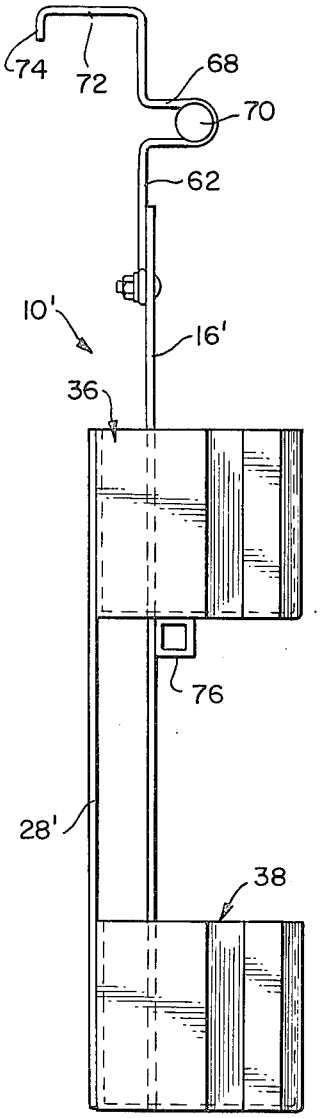
FIG. 6 is a side elevation of the embodiment illustrated in FIG. 5.
Figure 7:
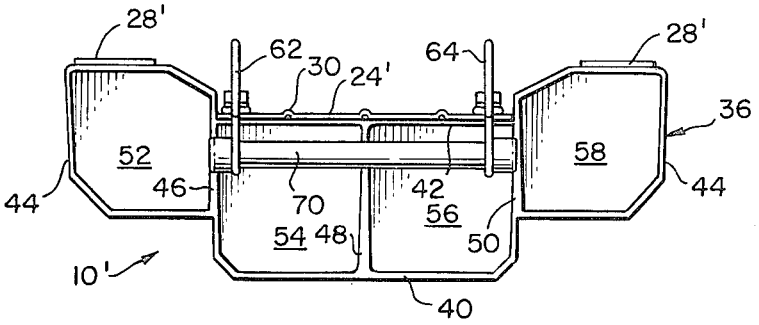
FIG. 7 is a plan view of the alternative embodiment illustrated in FIGS. 5 and 6.

In FIGS. 5–7 of the drawings, an alternative embodiment of the caddy is illustrated in which parts which are identical to parts described with reference to FIGS. 2–4 are designated by identical reference numerals whereas parts which are functionally similar but differing in structure are designated by the same reference numerals primed.

The embodiment of FIGS. 5–7 differs from the embodiment of FIGS. 2–4 primarily in the construction of the sheet-form standard 16. Thus, in the latter embodiment, the standard 16' having stiffening ribs 30, where necessary, is of a narrower width to nest completely against the back vertical walls 42 of the upper and lower compartmented units 36 and 38. The flanges 28 of the prior embodiment are replaced by slat-like equivalents 28' which extend vertically from the floor 60 of the bottom unit 38 to the top of the upper unit 36. Although the embodiment of FIGS. 5–7 represents a relatively lightweight caddy structure with correspondingly less strength, the offset connection of the slats 28' and the standard 16' with the compartmented units 36 and 38, as may be seen most clearly in FIGS. 6 and 7, provides a beam-like structure interconnecting the two units 36 and 38 in the sense that the standard 16' and slats 28' function as beam flanges and thus resist bending of the unit as a whole about a transverse axis. Also, increasing the thickness of the standard 16' and the slats 28' can account for needed strength. In all other respects, the embodiment of FIGS. 5–7 is the same as the embodiments of FIGS. 2–4.

The caddy 10 or 10' is preferably formed of high-strength plastic material such as polyethelyene, polystyrene or ABS. Although it is preferred that the compartmented units 36 and 38 be molded separately from the sheet-form standard 16 or 16' with subsequent assembly using adhesives or the like, it is contemplated also that the entire caddy may be integrally formed by appropriate injection molding techniques. In either case, the plastic material from which the caddy is formed may be brightly colored so that its presence on a trash dolly is easily recognized thus to facilitate its removal prior to emptying the dolly into a refuse receptacle.

Thus, it will be appreciated that as a result of the present invention, a highly effective janitorial caddy is provided by which the principal objective, among others, is completely fulfilled. It will be equally apparent and is contemplated that modifications and/or changes may be made in the illustrated embodiments without departure from the invention. Accordingly, it is expressly intended that the foregoing description and accompanying drawings are illustrative of preferred embodiments only, not limiting, and that the true spirit and scope of the present invention will be determined by reference to the appended claims.

I claim:

1. A caddy for janitorial cleaning supplies, said caddy comprising:

a substantially rigid, sheet-form standard having front and rear faces;

at least one compartmented unit having a plurality of interconnected vertical wall portions joined by a common, generally planar floor portion to define a single tier of open top cells in which cells at the ends of said tier are offset rearwardly from cells located in the central region of said tier, thereby to present a rearwardly concave, arc-like configuration in said unit, said compartmented unit being secured to the front face of said standard and so that the bottom of said standard is flush with the floor of said unit; and suspension means including a carrying handle and a pair of hooks positioned at the upper portion of said standard, said hooks having a rearwardly extending reach extending beyond a plane containing the rearwardmost surfaces of the caddy.

2. The apparatus recited in claim 1, including a pair of said compartmented units vertically spaced as upper and lower units on said standard.

3. The apparatus recited in claim 2, wherein said sheet-form standard includes a central channel section, a pair of edge flanges, and a pair of rearwardly and outwardly flared panel sections joining said central channel section to said edge flanges, thereby to provide a cross-sectional configuration in said standard to complement the rearwardly concave, arc-like configuration of said units.

4. The apparatus recited in claim 2, wherein said sheet-form standard is of a width less than the width of said compartmented units and including a pair of slat-like struts extending vertically and interconnecting the rear surfaces of said units projecting laterally beyond the width of said standard.

5. The apparatus recited in claim 1, wherein said hooks include means for mounting said carrying handle forwardly of said standard and at the approximate load center of said compartmented units.

* * * * *